US008061367B2

(12) United States Patent
Rabe et al.

(10) Patent No.: US 8,061,367 B2
(45) Date of Patent: Nov. 22, 2011

(54) EYELASH EXTENSION SYSTEM

(75) Inventors: Thomas Elliot Rabe, Baltimore, MD (US); Peter Jonathan Wyatt, Forest Hill, MD (US); Nancy Taylor Dempsey, Forest Hill, MD (US); Megan Mai Morys, Cambridge (GB); Robert Scadding Moir, Cambridge (GB); Howell Timothy Goldrein, Cambridge (GB); Kate Reeves, Berkshire (GB)

(73) Assignee: The Procter & Gamble Company, Cincinnati, OH (US)

( * ) Notice: Subject to any disclaimer, the term of this patent is extended or adjusted under 35 U.S.C. 154(b) by 425 days.

(21) Appl. No.: 12/245,409

(22) Filed: Oct. 3, 2008

(65) Prior Publication Data

US 2009/0217938 A1 Sep. 3, 2009

Related U.S. Application Data

(60) Provisional application No. 60/999,626, filed on Oct. 19, 2007.

(51) Int. Cl.
*A45D 40/30* (2006.01)
*A41G 3/00* (2006.01)

(52) U.S. Cl. ..... 132/216; 132/53

(58) Field of Classification Search ..... 132/216, 132/217, 201, 212, 218, 317, 319, 53–56, 132/320, 105, 106; D28/36; 623/15.11
See application file for complete search history.

(56) References Cited

U.S. PATENT DOCUMENTS

| | | | | |
|---|---|---|---|---|
| 1,450,259 | A | 4/1923 | Nessler | |
| 1,810,566 | A * | 6/1931 | Keney | 446/394 |
| 1,831,801 | A | 11/1931 | Birk | |
| 1,960,687 | A | 5/1934 | Wills | |
| 2,079,256 | A | 12/1936 | Kaiser | |
| 2,268,082 | A * | 12/1941 | Phillips, Sr. | 132/53 |
| 2,324,271 | A | 7/1943 | Adler | |
| 2,667,176 | A | 1/1954 | Lund | |
| 2,760,264 | A | 8/1956 | Javits | |
| 2,812,768 | A | 11/1957 | Giuliano | |
| 2,835,259 | A | 5/1958 | Bertrand | |
| 3,032,042 | A | 5/1962 | Borg | |
| 3,266,500 | A | 8/1966 | Weld | |
| 3,447,540 | A | 6/1969 | Osher | |
| 3,447,542 | A * | 6/1969 | McCullough | 132/53 |
| 3,461,886 | A | 8/1969 | Bau | |

(Continued)

FOREIGN PATENT DOCUMENTS

| | | |
|---|---|---|
| GB | 459930 | 1/1937 |

(Continued)

OTHER PUBLICATIONS

PCT International Search Report, date mailed: Apr. 2, 2009, 4 pages.

*Primary Examiner* — Todd Manahan
*Assistant Examiner* — Vanitha Elgart
(74) *Attorney, Agent, or Firm* — John G. Powell; Megan C. Hymore

(57) ABSTRACT

An eyelash extension system having a backbone and a plurality of eyelash extensions attached to the backbone. An adhesive is applied to an application surface of the backbone, and the adhesive is selected from the group of adhesives comprising latex adhesives, solvent-borne adhesives, pressure-sensitive adhesives (PSAs), and hot melt adhesives.

17 Claims, 4 Drawing Sheets

U.S. PATENT DOCUMENTS

| | | | | | |
|---|---|---|---|---|---|
| 3,478,754 | A | | 11/1969 | Martin, Jr. | |
| 3,511,248 | A | * | 5/1970 | Panda | 132/216 |
| 3,516,422 | A | | 6/1970 | Bechtold et al. | |
| 3,516,423 | A | * | 6/1970 | Seidler | 132/216 |
| 3,547,135 | A | | 12/1970 | Roos | |
| 3,556,113 | A | | 1/1971 | Frieder | |
| 3,559,657 | A | | 2/1971 | Bau | |
| 3,561,454 | A | | 2/1971 | O'Connell | |
| 3,670,742 | A | | 6/1972 | Weaner | |
| 3,722,519 | A | | 3/1973 | Epstein | |
| 3,828,803 | A | | 8/1974 | Windsor | |
| 3,831,202 | A | * | 8/1974 | Hulsen | 623/15.11 |
| 3,880,175 | A | * | 4/1975 | Hosokawa | 132/53 |
| 3,900,038 | A | | 8/1975 | Masters | |
| 4,018,336 | A | * | 4/1977 | Aylott | 206/460 |
| 4,029,111 | A | * | 6/1977 | Barton | 132/53 |
| 4,135,527 | A | | 1/1979 | Montiel | |
| 5,072,745 | A | * | 12/1991 | Cheh | 132/201 |
| 5,547,529 | A | | 8/1996 | Woolf | |
| 5,741,336 | A | * | 4/1998 | Fraser | 623/15.11 |
| 6,029,674 | A | | 2/2000 | Han | |
| 6,105,585 | A | | 8/2000 | Thomas | |
| 6,935,348 | B2 | * | 8/2005 | Gold | 132/53 |
| 2002/0056465 | A1 | | 5/2002 | Shin | |
| 2002/0198597 | A1 | * | 12/2002 | Godfrey | 623/15.11 |
| 2003/0005941 | A1 | | 1/2003 | Iosilevich | |
| 2005/0061341 | A1 | * | 3/2005 | Choe | 132/53 |
| 2007/0227550 | A1 | * | 10/2007 | Merszei | 132/53 |
| 2007/0295353 | A1 | * | 12/2007 | Dinh | 132/216 |
| 2009/0217939 | A1 | * | 9/2009 | Rabe et al. | 132/218 |
| 2010/0043814 | A1 | * | 2/2010 | Hamano | 132/107 |
| 2010/0043816 | A1 | * | 2/2010 | Dix | 132/201 |

FOREIGN PATENT DOCUMENTS

| | | |
|---|---|---|
| GB | 526272 | 9/1940 |
| GB | 621278 | 4/1949 |
| GB | 738832 | 10/1955 |
| GB | 921662 | 3/1963 |
| GB | 924631 | 4/1963 |
| GB | 1021063 | 2/1966 |
| GB | 1189251 | 4/1970 |
| GB | 1591975 | 7/1981 |
| JP | 10183415 | 7/1988 |
| JP | 2000027018 | 1/2000 |
| JP | 2002300918 | 10/2002 |
| JP | 2006113302 | 4/2006 |
| KR | 10-2004-0021201 | 5/2005 |
| WO | WO 00/30482 | 6/2000 |

* cited by examiner

EYELASH EXTENSION SYSTEM

CROSS REFERENCE TO RELATED APPLICATION

This application claims the benefit of U.S. Provisional Application No. 60/999,626 filed Oct. 19, 2007.

FIELD OF THE INVENTION

The present disclosure relates to eyelash extensions, and in particular eyelash extensions wherein a plurality of eyelash extensions are positioned as a group.

BACKGROUND OF THE INVENTION

Many people are dissatisfied with the look of their eyelashes. They would prefer lashes with better curl, color, fullness, length, etc. While cosmetic products, such as mascara, are available to improve these characteristics, certain people still would prefer even greater enhancements than are possible through their use of mascara alone.

False eyelashes have been around and in use for quite some time. False eyelashes are applied to the eyelid, and may improve the appearance of the wearer by making it appear that the wearer has eyelashes of greater curl, color, fullness, length, etc. However, false eyelashes also may make it appear that the user has more than one set of eyelashes if the application is not performed with a high degree of precision. Obtaining this degree of precision is a difficult task even for an experienced user.

Alternatively, one may try eyelash extensions. Unlike false eyelashes, eyelash extensions are applied directly to the eyelash, instead of to the eyelid. As a consequence, it does not appear as though the user has more than one set of eyelashes, but rather longer, curvier, darker, fuller, etc. eyelashes. There are drawbacks with this solution as well. At the present time, eyelash extensions are applied one by one to the existing eyelashes. As a consequence, the process is labor intensive, requires highly skilled application, and is expensive. Because the process is not easily amenable to self-application, the extensions are most commonly applied in the salon setting, and as the eyelashes fall out, repeated "maintenance" visits may be required. Also, because eyelash extensions are applied to existing eyelashes using a one-to-one ratio, if one has problems with eyelash count, extensions do little to improve the matter.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

The term "attached" refers to elements being connected or united by adhering, fastening, bonding, etc. by any method suitable for the elements being joined together. Many suitable methods for attaching elements together are well-known, including adhesive bonding, mechanical fastening, etc. Such attachment methods may be used to attach elements together over a particular area either continuously or intermittently.

The term "coupled" refers to configurations whereby an element is directly secured to another element by attaching the element directly to the other element, and to configurations whereby an element is indirectly secured to another element by attaching the element to intermediate member(s) that is(are) in turn attached to the other element.

The term "disposed" is used to mean that an element(s) exists in a particular place or position as a unitary structure with other elements or as a separate element coupled to other elements.

The term "effective diameter" refers to a measurement related to a cross-section. In regard to a circular cross-section, the effective diameter is the diameter of the cross-section. For non-circular cross-sections, the effective diameter may be more difficult to describe. However, one manner in which the effective diameter may be calculated is as the square root of four times the cross-sectional area divided by pi.

These terms may be defined with additional language in the remaining portions of the specification.

Figure 1:
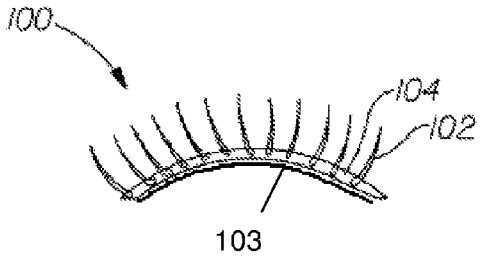
FIG. 1 is a perspective view of an eyelash extension system to be applied to a set of eyelashes.

An eyelash extension system 100 is illustrated in FIG. 1. The system 100 includes a plurality of eyelash extensions 102 and a backbone 104. The extensions 102 are attached to the backbone 104 and depend from the backbone 104. In use, the backbone 104 and/or the extensions 102 are attached to a set of eyelashes belonging to the user, as explained below, the extensions 102 appearing to extend from the user's eyelashes as a consequence.

It will be appreciated that there is considerable diversity in the structure and composition of the eyelash extensions 102, the backbone 104, the mechanism used to attach the extensions 102 to the backbone 104, and the mechanism used to attach the backbone 104 and/or the extensions 102 to the user's eyelashes. The following is a partial listing of the potential variations in regard to the extensions 102, the backbone 104 and attachment mechanisms. This listing is intended to be exemplary and non-limiting. Furthermore, much of this discussion will be generally applicable to the other embodiments described below.

In regard to the extensions 102, the extensions 102 may be made from biomaterials from animals, including humans, or plants (e.g. cotton). In particular, the extensions 102 may be made from keratinous material from an animal, such as eyelashes, although hair, fur, feathers, wool and silk may be used as well. The extensions 102 may also be made of synthetic materials, including nylon, polyester, and the like. In particular, synthetic fibers may be particularly well suited for use in the system 100. Also, the extensions 102 may be made of composite materials, which provide opportunities to use core/shell or layered cross-sectional designs to give the extensions 102 unique properties. This approach allows for separation of functionality. For example, one material of the composite can be chosen for its structural properties, and additional materials of the composite may be chosen for desirable phase transition, electromagnetic, surface energy, light refractivity, or other value-added properties.

The shape, color, effective diameter, length, curvature, and density of the extensions 102 may vary. The variation may be between extensions included in one system and those included in another system. However, the variations may be between individual extensions included in one particular system, or even within one individual lash extension in one particular system. For example, multiple lengths may be used in one particular system.

As to the shape, the extensions 102 may have a generally circular, solid cross-section, and may be tapered from one end of the extension 102 to the other. However, it is also possible for the extensions to have a non-circular cross-section, such as an elliptical cross-section. Alternatively, the cross-section may be a polygon, such as triangle, rectangle, etc., or more complex shape, such as a cross, a crescent, or a star. Further cross-sections of interest may effectively appear flat, such that the dimensions in one axis are at least 15 times those of the second axis. It is also possible for the cross-section to be hollow or tubular, instead of solid. Further, the extension 102 may have a nearly constant effective diameter from one end of the extension 102 to the other, or the effective diameter may vary in some fashion other than a taper.

Additionally, it is desirable to allow for multiple colors and goniometric properties of extensions which are applied to one set of lashes.

As to the effective diameter, a convention may be adopted where this characteristic is discussed relative to an effective diameter at a particular point along an extension, a maximum effective diameter of an extension, or an average of the effective diameters taken at a plurality of points along an extension, for example. Regardless of the convention adopted, a wide range of diameters may be used. For example, the extensions 102 may have an average effective diameter in the range of between about 0.01 mm and about 2.0 mm. According to other embodiments, the extensions 102 may have an average effective diameter in the range of between about 0.03 mm and about 1.0 mm. According to certain embodiments, the extensions 102 may have an average effective diameter in the range of between about 0.03 mm and about 0.70 mm.

As to the length (measured from end to end), a wide range of lengths may also be used. For example, the extensions 102 may have a length in the range of between about 1.0 mm and about 30.0 mm. According to other embodiments, the extensions 102 may have a length in the range of between about 2.0 mm and about 20.0 mm. According to certain embodiments, the extensions 102 may have a length in the range of between about 3.0 mm and about 15.0 mm.

As to the angle of curvature, there may also be a variety of conventions by which this is defined. As an example, one may discuss the angle of curvature in terms of the angle that is formed by the intersection of lines tangential to the ends of the extension. Again, a wide range may be used. For example, the extensions 102 may have an angle of curvature in the range of between about 3 and about 180 degrees. According to other embodiments, the extensions 102 may have an angle in the range of between about 30 and about 170 degrees. According to certain embodiments, the extensions 102 may have an angle in the range of between about 45 and about 160 degrees.

In regard to the backbone 104, the backbone 104 may be in the form of a thin strip, fiber, etc. of material to which the extensions 102 are attached. Similar to the extensions, the backbone 104 may be made of a biomaterial or a synthetic material. In fact, the backbone 104 may be made of a material such that, after attachment of the extensions 102 to the user's eyelashes, the backbone 104 may be dissolved or otherwise removed. In one embodiment, the backbone 104 may be made of a water-soluble material, while the extensions 102 and an adhesive applied thereto to attach the extensions 102 to the eyelashes may be water-insoluble. For instance, after the backbone 104 is used to carry and place the extensions 102 relative to the eyelashes so that the extensions 102 may attach themselves to the eyelashes, water is applied to the backbone 104 to remove (dissolve) the backbone 104. According to other embodiments, the backbone may be made of a more durable material, such that the backbone does not dissolve or otherwise disappear during normal use conditions.

The length of the backbone 104, as manufactured, may vary according to the present disclosure. For example, the backbone 104 may be manufactured in a length designed to provide coverage for users having an average eyelid length. Alternatively, the backbone 104 may be manufactured in lengths that are intended to be cut and/or trimmed by the user to be the exact length to provide a desired coverage, which may or may not coincide with the length of the user's eyelid. As a further alternative, the backbone 104 may be manufactured in lengths shorter than would be expected to permit coverage from one end of an eyelid to the other. According to such an embodiment, two, three or more lengths of backbone 104 may be used to provide coverage for a single eyelid and associated eyelashes.

As to the density of the extensions, a large range of densities may be appropriate. Provided that the extensions 102 are attached to a backbone 104, the linear density of the individual extensions across the backbone is preferably about 5-150 extensions per linear cm of backbone. More preferably, the linear density of the extensions 102 is about 10-100 extensions per linear cm of backbone 104.

The mechanism of attachment between the extensions 102 and backbone 104 may vary according to the nature of the extensions 102 and the backbone 104, and the thickness of the backbone 104. For instance, if the thickness of the backbone 104 is sufficient, the extensions 102 may be disposed or embedded at least partially within the backbone 104. This may be achieved, for example, by molding the backbone 104 about ends of the extensions 102. Alternatively, if the thickness of the backbone 104 is not substantially greater than the effective diameter of the extensions 102, the extensions 102 may be attached to a surface of the backbone 104 using an adhesive compatible with the materials used to form the extensions 102 and the backbone 104. Still another means of attaching the extensions 102 to the backbone 104 is through a knot or braid. Additionally, for synthetic extensions 102 or backbones 104 a means of spot welding may be particularly effective through the use of heat or other means of creating a phase transformation with or without the use of pressure.

The mechanism of attachment between the extensions 102 and/or backbone 104 to the user's existing eyelashes may also vary. As noted above, one mechanism of attachment may be an adhesive 103, which adhesive 103 may be disposed or applied on the extensions 102, the backbone 104, or both. The selection of the adhesive 103 may thus be influenced by the material used for the extensions 102 and/or the backbone 104, as well as the eyelashes. In this regard, it should be noted that the extensions 102, while intended for use with natural eyelashes as a replacement for false eyelashes, may be used with artificial eyelashes as well. Adhesives 103 may include, as non-limiting examples, latex adhesives, solvent-borne adhesives, pressure-sensitive adhesives (PSAs), and hot melt adhesives. Use of the latter type will require some degree of heating to occur at or near the time of application.

Additionally, phase transition materials may be used as a mechanism of attachment. These phase change materials may transition between a fluid state and a solid or semi-solid state, wherein the fluid state may have varying degrees of viscosity. For instance, the material may be a wax, such as may be formed of fatty materials or synthetic hydrocarbons. In such a case, a wax backbone may define the attachment mechanism as well, and may disperse upon application of heat. Alternatively, the material may be a gel that swells with contact to fluid. The mechanism to prompt the phase change may also vary, and may include temperature, electromagnetic radiation, moisture, and ultrasonic vibrations. In regard to electromagnetic radiation, this is not limited to the visible light scale, but may include all wavelengths, such as infrared and ultraviolet.

Figure 2:
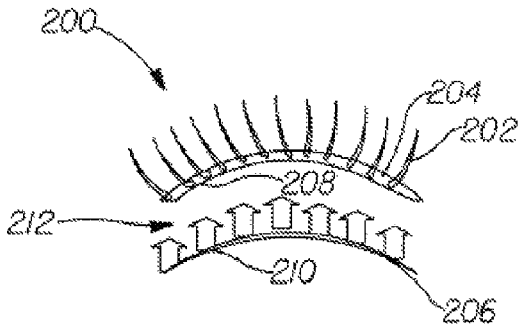
FIG. 2 is a perspective view of an eyelash extension system wherein a set of eyelashes is to be disposed between facing surfaces of the system.

FIG. 2 illustrates a system 200 including a plurality of eyelash extensions 202 attached to a backbone 204 and depending therefrom. The system 200 also includes a closure 206. In a preferred embodiment, the material and length of the closure 206 corresponds to the material and length of the backbone 204. The backbone 204 has a backbone surface 208, and the closure 206 has a closure surface 210. The closure 206 has a first state, as illustrated, wherein at least a part of the closure surface 210 is spaced from the backbone surface 208. As illustrated, the entire closure surface 210 is spaced from the backbone surface 208. The closure 206 also has a second state wherein the part of the closure surface 210 abuts the backbone surface 208.

It will be recognized that if a set of eyelashes is placed in the space 212 defined between the backbone surface 208 and the closure surface 210 with the closure 206 in the first state, at least some of the eyelashes will be disposed between the surfaces 208, 210 when the closure 206 is moved from the first state to the second state. The eyelashes disposed between the surfaces 208, 210 may be held therebetween by a variety of different attachment mechanisms. The nature of the attachment between the surfaces 208, 210 may limit the ability of the eyelashes to be removed from between the surfaces 208, 210, as may the interaction of the eyelashes with either or both of the surfaces 208, 210.

For example, an adhesive may be applied to one or both of the surfaces 208, 210, or, in an embodiment wherein a two-part adhesive (like epoxy) is used, one component of the adhesive may be applied to one surface 208, 210 and the other component may be applied to the other surface 208, 210. In this fashion, the adhesive may attach the surfaces 208, 210 together, thereby limiting removal of the eyelashes from between the surfaces 208, 210. The adhesive applied to one or both of the surfaces 208, 210 may also attach the eyelashes to one or both of the surfaces 208, 210, thereby further limiting removal of the eyelashes from between the surfaces 208, 210. Alternatively, the adhesive may be selected so as to attach the surfaces 208, 210 without attaching the eyelashes to either of the surfaces 208, 210.

Another alternative may be to use a hook-and-loop attachment mechanism. For example, the hook material may be attached to one of the backbone surface 208 and the closure surface 210, while the loop material may be attached to the other of the backbone surface 208 and the closure surface 210. With the surfaces 208, 210 abutting each other, pressure applied to one or both of the backbone 204 and the closure 206 may encourage the entanglement of the hooks of the hook material in the loops of the loop material. It will be recognized that the hooks may instead be projections terminating in a button-shaped end, and the loops need not be closed. Other variations on the hook-and-loop attachment mechanisms will also be recognized as applicable to this embodiment.

As still another alternative, the backbone 204 and the closure 206 may be coupled to each other by magnetic fields. That is, the backbone 204 and the closure 206 may be coupled together, at least in part, by the magnetic force between two objects—such as between two magnets, or between a magnet and a material having a medium or higher magnetic permeability, such as iron. According to such an embodiment, the backbone 204, the closure 206 or both may be made in whole or in part of the material providing the magnetic coupling. That is, the backbone 204, for example, need not be made entirely of the material providing the magnetic coupling; instead, the backbone 204 may be made of a plastic material in which is embedded particles of the other material.

It is not necessary that the backbone 204 and the closure 206 be separate pieces of the system, as illustrated in FIG. 2.

Instead, the backbone and the closure may be attached at least in part to each other. FIGS. 3A-C and 4 illustrate exemplary embodiments wherein the backbone is attached to the closure. According to certain embodiments, the attachment of the backbone and the closure may provide, in whole or in part, the attachment mechanism for limiting removal of the eyelashes from the extension system.

Figure 3A:
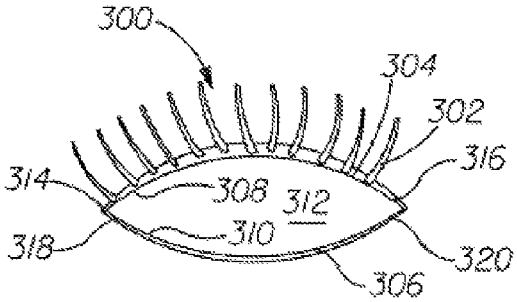
FIG. 3A is a perspective view of an open state of an eyelash extension system wherein a set of eyelashes may be disposed between facing surfaces of the system, the system including opposing strips attached at both ends.
Figure 3B:
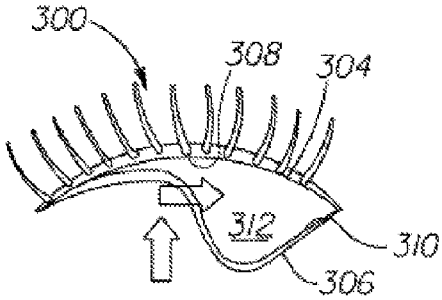
FIG. 3B is a perspective view of an intermediate state of the system of FIG. 3A.
Figure 3C:
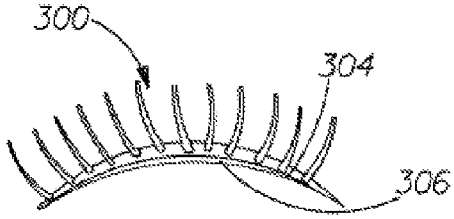
FIG. 3C is a perspective view of a closed state of the system of FIG. 3A.

FIGS. 3A-C illustrate a system 300 including a set of eyelash extensions 302 that are attached to a backbone 304. The system 300 also includes a closure 306. The backbone 304 has a backbone surface 308, and the closure 306 has a closure surface 310. The surfaces 308, 310 define a space 312 therebetween for the insertion of a set of eyelashes. The closure has a first state (FIG. 3A) wherein the surfaces 308, 310 are spaced, and a second state (FIG. 3C) wherein the surfaces 308, 310 abut.

However, unlike the embodiments discussed above, the backbone 304 and closure 306 are attached to each other. In particular, the strip-like backbone 304 has opposed, spaced ends 314, 316, and the strip-like closure 306 has opposed, spaced ends 318, 320. The ends 314, 318 are attached together, as are the ends 316, 320. According to one embodiment, the ends 314, 318 and 316, 320 are in the form of a pair of living hinges, although it will be recognized that the backbone 304 and the closure 306 may be separate pieces that are attached by some other mechanism at the ends 314, 316, 318, 320.

In use, pressure is applied to the closure 306 to change the concavity of the closure surface 310, and in the process move the surfaces 308, 310 into abutment. That is, as a finger or tool is moved from left to right, for example, along the closure 306, the shape of the closure surface 310 changes from concave to convex, with the closure surface 310 moving toward the backbone surface 308 (which is concave in shape). As the movement continues, from FIG. 3A to FIG. 3B to FIG. 3C, eyelashes initially disposed in the space 312 between the surfaces 308, 310 become trapped between the surfaces 308, 310, with their removal from the space 312 being limited as a consequence. It will be recognized that adhesive or another attachment mechanism may be used as well to further limit removal of the eyelashes from between the surfaces 308, 310.

Figure 4:
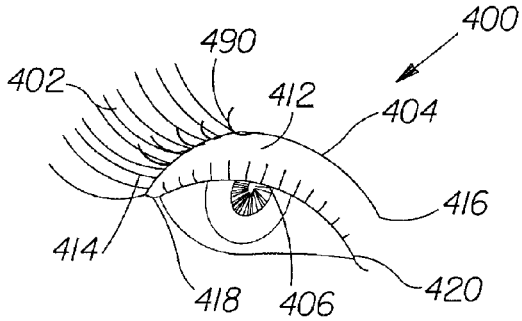
FIG. 4 is a perspective view of an eyelash extension system wherein a set of eyelashes is disposed between facing surfaces of the system, the system including opposing strips attached at one end.

FIG. 4 illustrates a system 400 wherein a backbone 404 and closure 406 are attached at one end, but not both ends. Rather, the backbone 404 has ends 414, 416; the closure 406 has ends 418, 420; and only the ends 414, 418 are attached. Ends 416, 420 are not attached, and are instead initially spaced from each other in the first state of the closure 406, although the ends 416, 420 may abut in the second state of the closure 406. The closure 406 may be maintained in the second state through the action of the hinge formed by the attached ends 414, 418, or the closure 406 may be maintained in the second state through the use of an adhesive in combination or in substitution for the action of the hinge. The backbone 404 and closure 406 define a space 412 wherein eyelashes 490 may be disposed.

FIGS. 5-7B present a different mechanism of attachment to attach the extension to the eyelashes. The attachment mechanism is similar to the embodiments of FIGS. 2-4 in that the system does rely on placing the eyelashes between opposing surfaces to limit relative movement of the eyelashes and the extensions, in whole or in part. However, the surfaces are defined by the extensions and one or more projections depending from the extensions.

Figure 5:
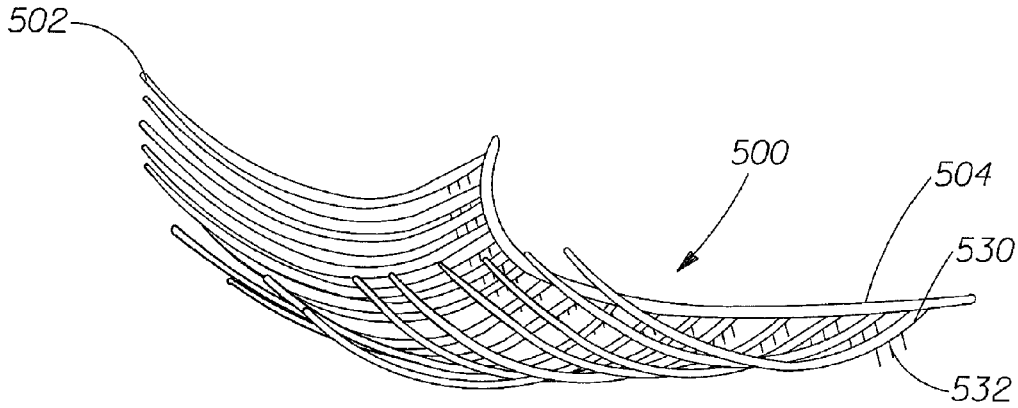
FIG. 5 is a perspective view of an eyelash extension system wherein a set of eyelashes is disposed between facing surfaces of the system, wherein one of the surfaces is defined on projections attached to the eyelash extensions.

That is, the system 500 in FIG. 5 includes a set of eyelash extensions 502 that are attached at their ends to a backbone 504. The extensions 502 have a surface 530 that may be intended to abut a surface of the eyelash or eyelashes to which the extensions 502 are to be attached. A plurality of projections 532 are attached to the extensions 502. In particular, the extensions 502 may be attached to the extensions 502 on the surface 530 of the extensions 502. The extensions 502 may also be attached to the extensions 502 on a surface opposite the surface 530. While, as illustrated, each of the extensions 502 has a plurality of projections 532 attached thereto and depending therefrom, according to other embodiments, certain extensions 502 may include only one or no projections 532. Embodiments wherein each extension 502 has multiple projections 532 depending therefrom may be particularly well suited to an embodiment wherein the backbone 504 may be dissolved or otherwise removed after attachment of the extensions 502 to the eyelashes.

Figure 6:
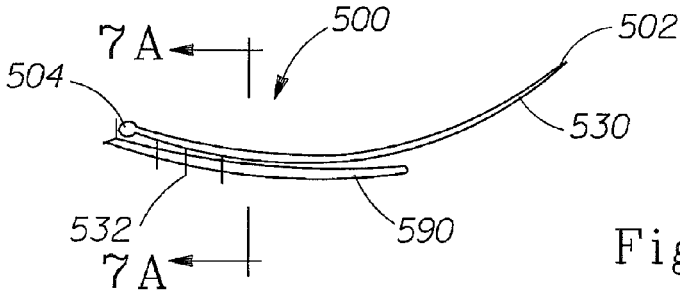
FIG. 6 is a side view of the system of FIG. 5 attached to an eyelash.
Figure 7A:
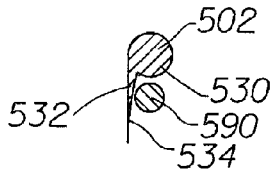
FIG. 7A is a cross-sectional view of the embodiment of the system of FIG. 5, taken along the line 1-1 as shown in FIG. 6, with a projection depending from the eyelash extension in a first, extended state.
Figure 7B:
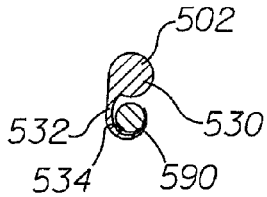
FIG. 7B is a cross-sectional view of the embodiment of the system of FIG. 5, taken along the line 1-1 as shown in FIG. 6, with a projection depending from the eyelash extension in a second, retracted state.

In an initial step illustrated in FIG. 6, the set of extensions 502 and associated backbone 504 may be positioned relative to the eyelashes 590 such that the surface 530 at least faces the eyelashes 590. With the system 500 so positioned, the projections 532 depend past the eyelashes 532, as may be best seen in FIG. 7A. According to this embodiment, the projections 532 have a first state wherein they are initially straight, with the surface 534 facing away from the extension 502. After the system is positioned, a heat source is placed proximate to the system 500, and in particular proximate to the projections 532. The projections 532 are formed of a material that changes its shape in response to heat, transitioning from the first state wherein the shape is illustrated as in FIG. 7A to a second state wherein the shape is as illustrated in FIG. 7B. In doing so, the surface 534 faces towards the extension 502 with the eyelash(es) disposed therebetween.

In a preferred embodiment, the projections 532 are intended to have or to take the shape of hook-like structures, such as is illustrated in FIG. 7B. The hook-like projection 532 has a surface 534 that faces towards the extension 502 so as to hold an eyelash between the surface and the extension 502. As illustrated in FIG. 7B, the hook-like projection 532 surrounds the entire periphery of an eyelash 590. It will be understood that while a single eyelash is illustrated, the projection 532 could have surrounded a group of eyelashes instead. It is not necessary that the projection 532 surround the entirety of the periphery of the eyelash 590. Instead, the hook-like projection may only extend about a percentage of the entire periphery; in fact, different projections may be arranged to cover different percentages and on opposite sides from each other across the eyelash 590. Moreover, as stated above, the projections 532 may take this shape after the extensions 502 are positioned on the eyelashes, but not before. In other embodiments, the projections 532 do not have or take the shape of hook-like structures.

Still further mechanical attachment mechanisms are illustrated in FIGS. 8A-C and 9A-B. These embodiments illustrate a mechanism by which an eyelash or eyelashes are coupled to the extensions by trapping the eyelashes between two surfaces that are initially spaced from each other. In this regard, the embodiments of FIGS. 8A-C and 9A-B are similar to the embodiments illustrated in FIGS. 2-4, and in particular FIG. 4. However, unlike FIG. 4, in which the opposing surfaces may extend along the entire length of the eyelid, the opposing surfaces of the embodiments of FIGS. 8A-C and 9A-B extend only over a fraction of the distance, and thus are capable of gathering only a fraction of the eyelashes possible with a system such as illustrated in FIG. 4.

Figure 8A:
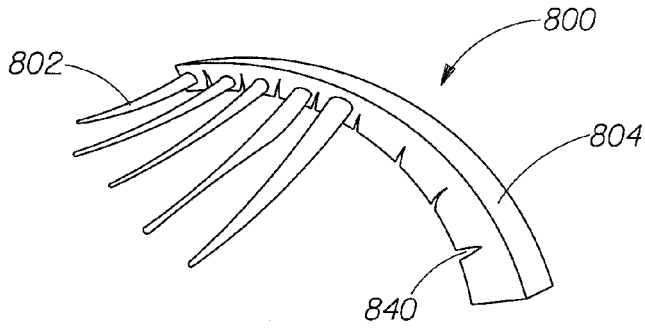
FIG. 8A is a perspective view of a closed state of an eyelash extension system wherein a set of eyelashes is disposed between facing surfaces of the system, wherein the surfaces are defined by a plurality of slits.
Figure 8B:
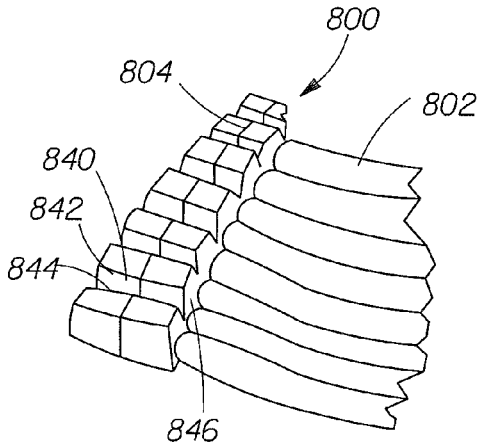
FIG. 8B is a partial, perspective view of an open state of the system of FIG. 8A.

Turning first to FIG. 8A, the system 800 includes a set of eyelash extensions 802 attached to a backbone 804. The backbone 804 includes a plurality of slits 840. As best seen in FIG. 8B, each slit 840 is defined by a first surface portion 842 and a second surface portion 844. A pivot 846 is disposed between the first and second surface portions 842, 844 (or, the structures on which the first and second surfaces are defined). According to the embodiment illustrated in FIGS. 8A-C, the slits 840 are integral to the backbone 804, and the pivots 846 are provided in the form of living hinges.

Figure 8C:
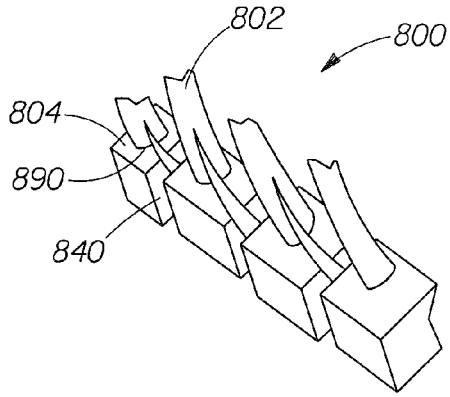
FIG. 8C is a partial, perspective view of an intermediate state of the system of FIG. 8A with a plurality of eyelashes disposed in slits.

According to the system 800, the first surface portion 842 and the second surface portion 844 are spaced from each other in a first state, as illustrated in FIG. 8B, and the first surface portion 842 abuts the second surface portion 844 in a second state, as illustrated in FIG. 8A. As the surface portions 842, 844 move between their orientations in the first state and in the second state, eyelashes 890 may become trapped in the slit 840 between the surface portions 842, 844, as shown in FIG. 8C. To transition the surface portions 842, 844 between the first and second states, the curvature of the backbone 804 is altered. That is, the backbone 804 is concave toward the bottom of the page in FIG. 8A, with the surfaces 842, 844 abutting each other. By straightening the backbone 804 to the orientation illustrated in FIG. 8B, the surfaces 842, 844 are spaced from each other. The backbone 804 is then positioned relative to the user's eyelashes, as illustrated in FIG. 8C, and the backbone 804 is returned to its state in FIG. 8A. The pivots 846 may be biased toward the orientation illustrated in FIG. 8A, and so returning the backbone to that state may require little more than removing the force applied to the backbone to straighten it.

It will be recognized that it is not necessary that the system 800 have a concave curvature in its operational state (i.e., the state in which it is attached to the eyelashes). The backbone 804 could instead be straight in the operational state, in which case the backbone 804 may be bent to space the surfaces 842, 844 from each other. In fact, the backbone 804 could have a convex curvature in the operational state, in which case the backbone 804 may be bent to a more extreme convex curvature than is present in the operational state to space the surfaces 842, 844.

Figure 9A:
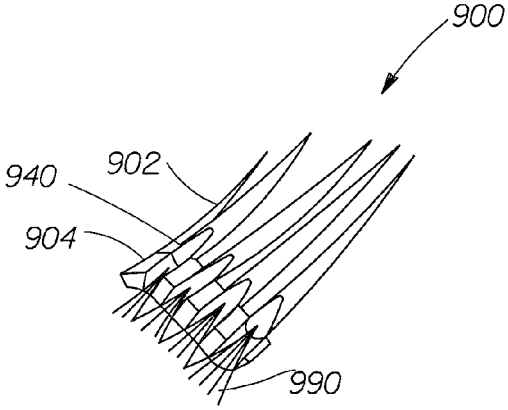
FIG. 9A is a perspective view of a closed state of an eyelash extension system wherein a set of eyelashes is disposed between facing surfaces of the system, wherein the surfaces are defined by a plurality of clips.
Figure 9B:
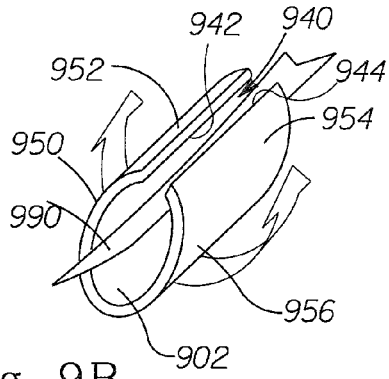
FIG. 9B is a partial, enlarged, perspective view of an open state of the system of FIG. 9A.

Nor is it necessary that the slits be integral with the backbone. FIGS. 9A and 9B illustrate a different embodiment, wherein the surface portions and pivots are defined by a structure that is then attached to the backbone. In this regard, the embodiment of FIGS. 9A and 9B is similar to that of FIG. 5 in that the attachment mechanism associates eyelashes and extensions, as the backbone may be dissolved or otherwise removed after this association occurs.

In particular, the system 900 illustrated in FIGS. 9A and 9B includes a set of extensions 902, a backbone 904, and a plurality of clips 950. The clips 950 comprise the surfaces 942, 944 which define a space 940 wherein the eyelashes 990 may be disposed. As best seen in FIG. 9B, the clips 950 are C-shaped, with a first arm 952 and a second arm 954 attached to a hinge 956 at first ends. The second ends of the arms 952, 954 are free to move relative to each other. The surfaces 942, 944 are defined on facing portions of the arms 952, 954. Movement of the arms 952, 954 towards each other moves the surfaces 942, 944 from the first state to the second state. Movement may be achieved through the use of fingers or a tool.

As seen in FIGS. 9A and 9B, the extensions 902 are attached to the clips 950, which are in turn attached to the backbone 904. As illustrated, one extension 902 is associated with one clip 950. Similarly, in FIG. 9B, one eyelash 990 is associated with one clip 950. Thus, it will be recognized that one or more extensions 902 may be associated with each clip 950, while one or more eyelashes 990 may also be associated with each clip 950. According to certain embodiments, the clip 950 and the extensions 902 may be formed as parts of an integral whole.

FIGS. 10-12B illustrate certain structures that may also be used as a mechanism to attach extensions to eyelashes. However, it may also be that the structures provide additional or alternative functionality as a positioning mechanism. As such, they may be used with any of the preceding embodiments as well.

Figure 10:
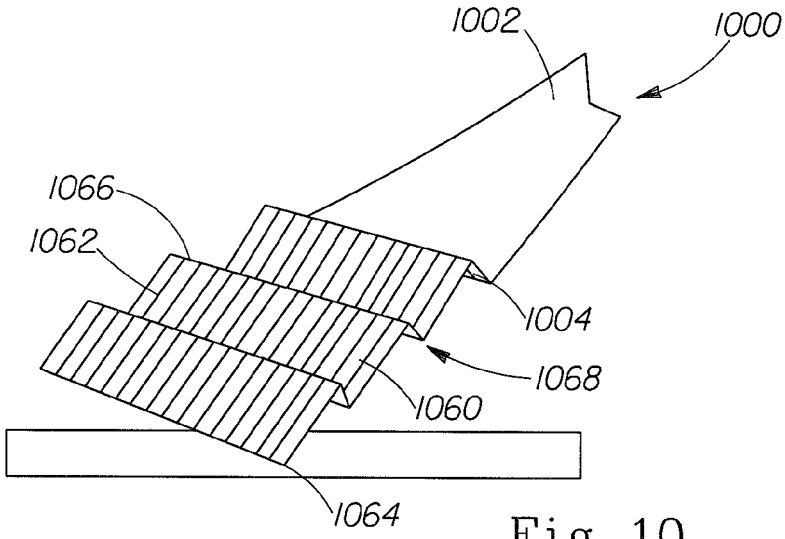
FIG. 10 is a perspective view of an eyelash extension system wherein a plurality of openings is provided to receive a plurality of eyelashes.
Figure 11A:
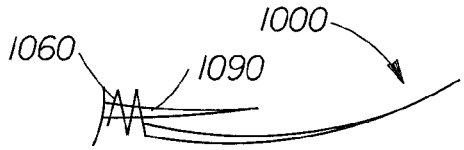
FIG. 11A is a side view of the system of FIG. 10 in a pre-installation state.
Figure 11B:
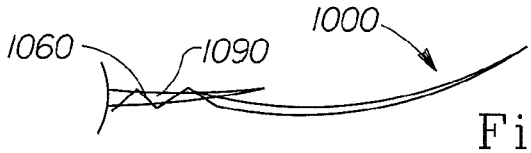
FIG. 11B is a side view of the system of FIG. 10 in an installed state.

A system 1000 is illustrated in FIGS. 10 and 11A-B that includes a set of extensions 1002 and a backbone 1004. Associated with the backbone 1004 is a net 1060. The net 1060 includes a plurality of ribs 1062 that depend away from the backbone 1004 to an opposing edge 1064 of the net 1060. The net also includes a plurality of cross-members 1066 that depend between the ribs 1062. As illustrated, the ribs 1062 and cross-members 1066 form a grid-like net 1060, the ribs 1062 and cross-members 1066 being orthogonal to each other. As also illustrated, the net 1060 has multiple folds 1068. In other embodiments, the ribs 1062 and cross-members 1066 may form a grid-like net 1060 by depending in directions other than orthogonal to each other. Or, the net 1060 may be made from a material having an inherent trapping ability. It is believed that by passing the eyelashes 1090 through the net 1060, and applying force to the net 1060 outwardly from the eye, the folds 1068 may be straightened, trapping the eyelashes in the net 1060 and attaching the extensions 1002 to the eyelashes 1090. For instance, the net 1060 may move from the position in FIG. 11A to the position in FIG. 11B.

Figure 12A:
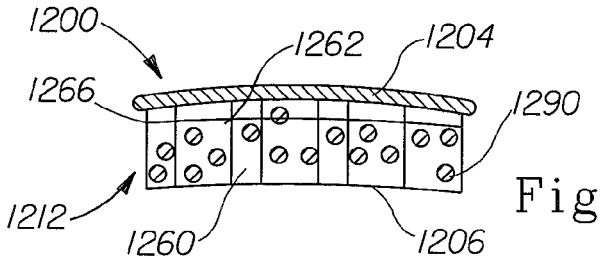
FIG. 12A is an end view of a pre-installation state of an alternative eyelash extension system wherein a plurality of openings are provided to receive a plurality of eyelashes.
Figure 12B:
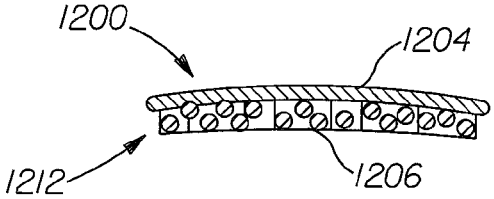
FIG. 12B is an end view of the system of FIG. 12A in an installed state.

However, an alternative benefit to the use of such a structure is as a positioning mechanism for the other embodiments discussed above. For example, a system 1200 is illustrated in FIGS. 12A and 12B. The system 1200 includes a backbone 1204 and a closure 1206, similar to many of the embodiments discussed above. The closure 1206 has a first state, illustrated in FIG. 12A, wherein the closure 1206 is spaced from the backbone 1204, and a second state, illustrated in FIG. 12B, wherein the closure 1206 abuts the backbone 1204. With the closure 1206 in the second state, the eyelashes 1290 are disposed between opposing surfaces of the backbone 1204 and closure 1206, thereby limiting the possibility for removing the eyelashes from the system 1200.

Also included in the system 1200 is a plurality of ribs 1262 that extend between the backbone 1204 and the closure 1206. While a plurality of ribs 1262 is shown, only one rib 1262 may be included in certain embodiments. Additionally, a plurality of cross-members 1266 may be included, which cross-members 1266 define a net 1260 with the ribs 1262. According to other embodiments, the cross-members 1266 may be removed.

As illustrated, the eyelashes 1290 depend between the ribs 1262 and the cross-members 1266. By placing the ribs 1262 between the backbone 1204 and the closure 1206, the ribs 1262 may facilitate the visualization of the eyelashes 1260 and their positioning in the space 1212 between the backbone 1204 and closure 1206, facilitating proper positioning of the system 1200. After performing this function, the ribs 1262 may contract as the backbone 1204 and closure 1206 come together, where the ribs 1262 are made of an elastic material, for example. However, the ribs 1262 may alternatively be formed of a highly brittle material, such that as the backbone 1204 approaches the closure 1206, the ribs 1262 fracture, with the pieces of the fractured ribs 1262 being ejected from the system 1260. The ribs 1262 may be manufactured with a mechanism that facilitates ejection from the system 1260 in the direction away from the eye.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An eyelash extension system comprising:

a backbone having a backbone surface and a backbone strip with opposed first and second ends;

a plurality of eyelash extensions attached to the backbone and depending therefrom;

a closure having a closure surface facing the backbone surface and a closure strip, the closure surface being substantially free of eyelash extensions, the closure strip having opposed first and second ends, wherein the first end of the backbone strip is attached to the first end of the closure strip and the second end of the backbone strip is attached to the second end of the closure strip, the closure having a first state wherein at least a part of the closure surface is spaced from the backbone surface, and a second state wherein the part of the closure surface abuts the backbone surface, wherein the backbone surface and the closure surface are both concave in the first state, and the backbone surface is concave and the closure surface is convex in the second state.

2. The eyelash extension system of claim 1, wherein the part of the closure surface abutting the backbone surface is attached to the backbone surface in the second state.

3. The eyelash extension system of claim 2, comprising an adhesive applied to one or both of the backbone surface and the closure surface.

4. The eyelash extension system of claim 2, wherein the part of the closure surface abutting the backbone surface is magnetically coupled to the backbone surface in the second state.

5. The eyelash extension system of claim 1, comprising at least one rib extending from the backbone surface to the closure surface.

6. The eyelash extension system of claim 5, comprising a plurality of ribs extending from the backbone surface to the closure surface.

7. The eyelash extension system of claim 6, wherein the plurality of ribs contract as the closure moves between the first state and the second state.

8. The eyelash extension system of claim 6, wherein the plurality of ribs fracture as the closure moves between the first state and the second state.

9. An eyelash extension system comprising:

a backbone;

a plurality of eyelash extensions attached to the backbone and depending therefrom; and a plurality of projections depending from at least some of the eyelash extensions, the projections having a surface facing toward the extensions from which the projections depend to hold an eyelash between the surface and the extension.

10. The eyelash extension system of claim 9, wherein the projections have a first state wherein the surface faces away from the extensions from which the projections depend, and a second state wherein the surface faces towards the extensions from which the projections depend.

11. The eyelash extension system of claim 10, wherein the projections transition between the first state and the second state in response to heat.

12. An eyelash extension system comprising:

a backbone comprising a plurality of slits, each slit defined by a first surface portion and a second surface portion, the first surface portion and the second surface portion being spaced from each other in a first state and the first surface portion and the second surface portion abutting each other in a second state; and a plurality of eyelash extensions attached to the backbone and depending therefrom.

13. The eyelash extension system of claim 12, comprising a plurality of pivots, each pivot disposed between one of the first surface portions and one of the second surface portions.

14. The eyelash extension system of claim 13, wherein the pivots comprise living hinges.

15. The eyelash extension system of claim 13, wherein the plurality of hinges are integral to the backbone.

16. The eyelash extension system of claim 12, wherein the backbone has a backbone surface in which the slits are formed, the backbone surface being concave in the second state and not concave in the first state.

17. The eyelash extension system of claim 13, wherein the pivot is biased toward the second state.

* * * * *